United States Patent [19]

Teague

[11] Patent Number: 4,667,919

[45] Date of Patent: May 26, 1987

[54] CLIPBOARD HOLDER

[76] Inventor: John E. Teague, 201 S. Larchmont Ave., Chattanooga, Tenn. 37411

[21] Appl. No.: 798,820

[22] Filed: Nov. 18, 1985

[51] Int. Cl.[4] ..... A47B 97/04

[52] U.S. Cl. ..... 248/450; 248/346; 248/DIG. 12; 281/45

[58] Field of Search ..... 248/441.1, 450, 454, 248/473, 346, DIG. 12; D19/88, 91; 40/152.1, 10 R, 606, 124, 124.1, 341; 281/45

[56] References Cited

U.S. PATENT DOCUMENTS

| | | | |
|---|---|---|---|
| D. 70,904 | 8/1926 | Salz | D19/83 |
| D. 181,305 | 10/1957 | Martino | D19/83 |
| 1,386,469 | 8/1921 | Gomoll | 248/473 |
| 1,436,544 | 11/1922 | Starr | 248/474 |
| 1,681,527 | 8/1928 | Egan | 248/473 |
| 1,681,586 | 8/1928 | Kessler | 248/441.1 |
| 1,768,675 | 7/1930 | Egan | 40/124.1 |
| 2,112,583 | 3/1938 | Tucker | 40/152.1 |
| 2,550,857 | 5/1951 | Overbaugh | 40/124.1 |
| 2,767,497 | 10/1956 | Munson | 248/473 |
| 3,029,548 | 4/1962 | Braha | 248/455 |
| 3,104,895 | 9/1963 | Feuerbach | 248/455 |
| 3,272,183 | 9/1966 | Craighead | 248/441.1 |
| 3,326,387 | 6/1967 | Princevalle | 211/41 |
| 3,332,399 | 7/1967 | Patrick . | |
| 3,507,245 | 4/1970 | Grabow | 248/473 |
| 3,952,989 | 4/1976 | Bannister Hatcher | 248/454 |
| 4,291,882 | 9/1981 | Del Monte | 40/124 |
| 4,466,593 | 8/1984 | Odenath | 248/460 |
| 4,483,505 | 11/1984 | Dalbo | 248/460 |

FOREIGN PATENT DOCUMENTS

| | | | |
|---|---|---|---|
| 906587 | 5/1945 | France | 248/473 |

*Primary Examiner*—J. Franklin Foss
*Assistant Examiner*—Robert A. Olson

[57] ABSTRACT

A device for holding a clipboard at different angles from the vertical to view written material held by the clipboard including a base having slots at various angles into which the base of the clipboard is inserted and having a furrow adjacent to each slot for holding a writing instrument.

2 Claims, 3 Drawing Figures

CLIPBOARD HOLDER

BACKGROUND OF THE INVENTION

It is common practice to use clipboards to hold orders, invoices and other papers in stock rooms, warehouses, offices and other places when filling orders and performing other tasks during which it is essential to look often at a paper on which information is written. When only the clipboard holding a paper is available, it is usually laid upon a flat surface or sometimes leaned against a vertical object. Such positioning of a clipboard is not usually convenient to the viewer of the material held by the clipboard. It is thus more convenient to have a holder for a clipboard which can hold a clipboard at an angle convenient for quick viewing.

The following patents were located on a preliminary search:

| | | | | | |
|---|---|---|---|---|---|
| 1,436,544 | Starr | 11/21/22 | 3,507,245 | Grabow | 4/21/70 |
| 2,767,497 | Munson | 10/23/56 | 3,952,989 | Hatcher | 4/27/76 |
| 3,029,548 | Braha | 4/17/62 | 4,466,593 | Odenath | 8/21/84 |
| 3,104,895 | Feuerbach | 9/24/63 | 4,483,505 | Dalbo | 11/20/84 |
| 3,332,399 | Patrick | 7/25/67 | | | |

DESCRIPTION OF THE PREFERRED EMBODIMENT

Figure 2:
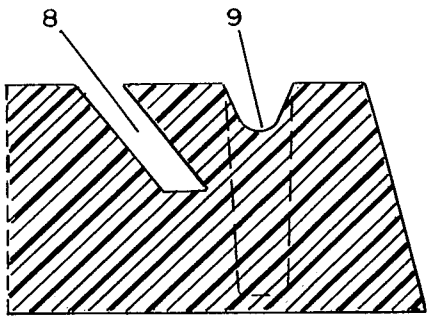
FIG. 2 is a cross-sectional view, on the line 2—2 of FIG. 1 showing the slot and furrow, on one side of the base.

A clipboard holder, when made with a base of square or rectangular shape, has ends 1 & 2 and sides 3 and 4. Each end and side has a slot 5, 6, 7 and 8. As shown in FIG. 2, each slot is sloped at a different angle to the vertical to suit the convenience of the user of the base. These angles will vary according to the side which the user of the clipboard holder wishes to use at the time. For example, side 4 has a slot 8 angled at about 40 degrees to the vertical. Also, as shown in FIG. 2, the base 4 has a channel or groove 9 for holding a writing instrument, such as a pencil or pen. Slot 8 would be about $\frac{1}{4}$ of an inch wide at its top and tapered down to about 3/16 of an inch wide at the bottom of the $\frac{3}{4}$ inch deep slot. (This graduated incline of the slot will be of use, not only in stacking purposes, it could possibly facilitate the manufacture of the device.) The angle of the slot 8 should be slanted inward from the front side of the clipboard, so that the clipboard will be held at a suitable angle for viewing quickly. The slope of the slots would vary in the case of a rectangular base from 10 degrees to the vertical for slot 5, 20 degrees to the vertical for slot 6, 30 degrees to the vertical for slot 7 and 40 degrees from the vertical for slot 8. Each side of the clipboard holder should be ten inches long, approximately, and 1 and $\frac{3}{4}$ inches in height. The width should be about 1 and $\frac{1}{4}$ inch at the top side of each side of the device and flared downward to 1 and $\frac{1}{2}$ inch at the bottom of the clipboard holder, for stacking purposes. Grooves for holding a writing instrument are those numbered 9, 10, 11, and 12 and should be preferably about 7 inches in length.

Figure 1:
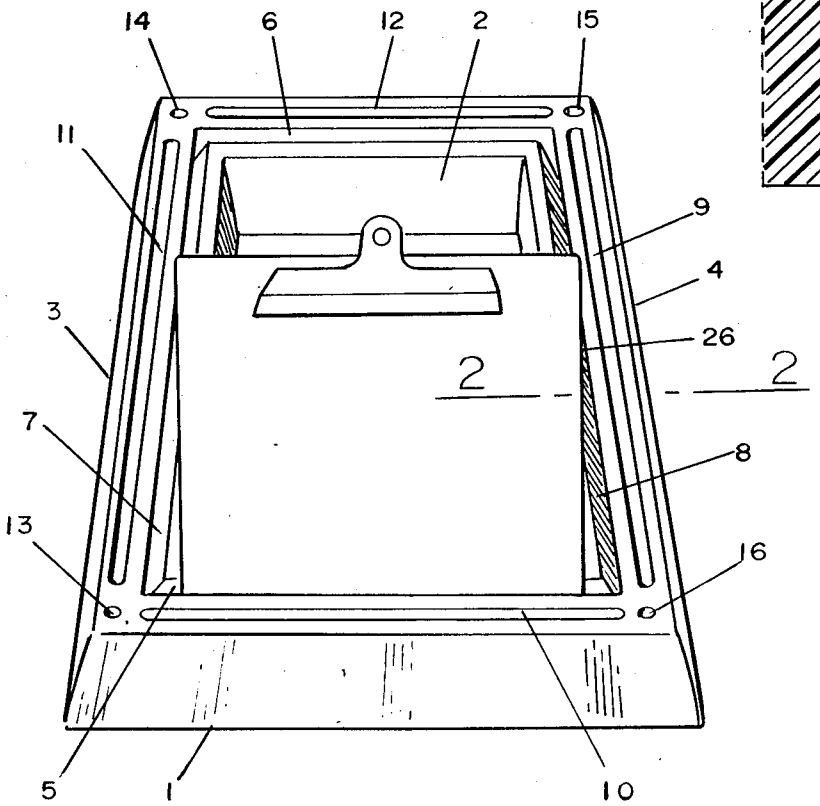
FIG. 1 is a perspective view, from above, of one embodiment of my invention, in rectangular shape of the base, showing slots for holding a clipboard adjacent to each side of the base and a furrow near each slot to hold a writing instrument.

Each corner of the clipboard holder should have a round recessed indentation identified as numbers 13, 14, 15 and 16 in FIG. 1 of the drawings. Each indentation should preferably be about $\frac{3}{8}$ inch in diameter at the top and flared downwardly 1 and $\frac{3}{4}$ inches to $\frac{1}{4}$ inch in diameter at its bottom. These indentations will also serve as pencil or pen holders. The entire clipboard holder device should be molded or stamped out of sheets of metal, or preferably plastic, in a one piece device.

Figure 3:
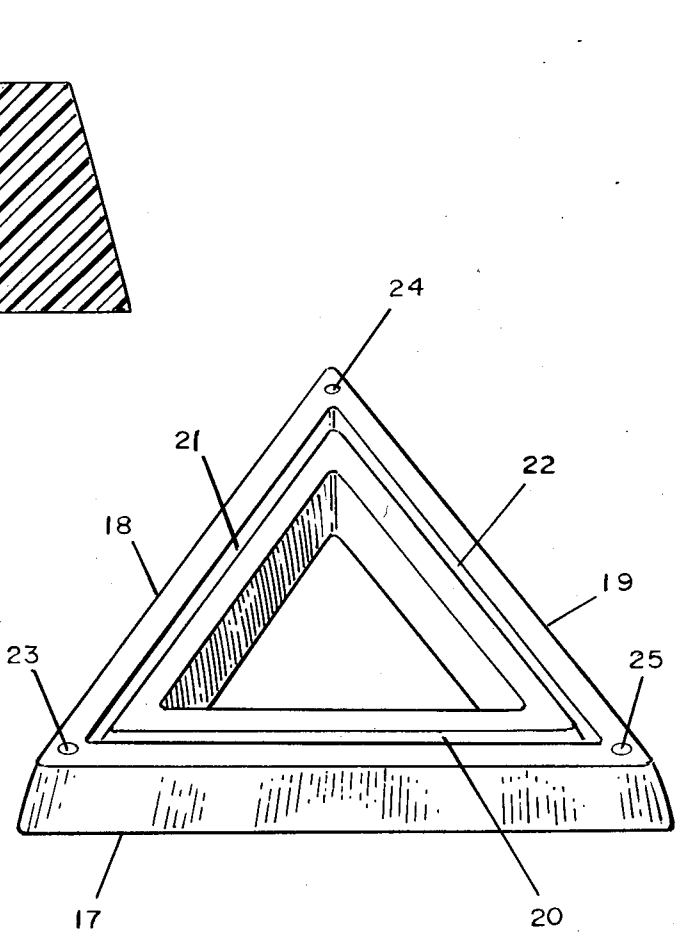
FIG. 3 is a perspective view from above, of another embodiment of my invention, in triangular shape of the base.

Another form of my invention is shown in FIG. 3, in which the base is triangular in shape, having three sides, 17, 18 and 19. In this form of the invention, the base has three slots 20, 21 and 22 which have three slants to the vertical, slot number 20 being slanted about 10 degrees to the vertical, slot 21 being about 20 degrees to the vertical and slot 22 being about 30 degrees to the vertical. As in the rectangular form of the clipboard holder, the triangular form shown in FIG. 3 has recessed indentations at the corners of the device, numbered 23, 24 and 25. The indentations are, as in the case of the rectangular shape, for the purpose of holding writing instruments, such as pencils or pens. The clipboard holder is designed for the purpose of holding a clipboard, with attached material, in a firm and immovable position as to the requirement of the person using it. A clipboard 25 is shown in place in FIG. 1.

The clipboard holder can sit on any flat surface and its main features are its simplicity, its uses in many occupations and it should be affordable to almost everyone. It can be used in many different occupations, such as by stockroom attendants, receptionists, copy writers and all other secretarial jobs and especially by persons who type from copy. It is designed for the purpose of holding a clipboard in a firm and immovable position. It would be designed to withstand the rough and rugged treatment it would surely be subjected to in stockrooms, warehouses and other numerous places where clipboards are used. The "one piece" multiplied degree angled clipboard holder is designed to be virtually indestructible.

I claim:

1. A device for use as a holder for a rigid clipboard including a truncated pyramid base having straight sides, elongated slots adjacent and parallel to each side of the base for holding the bottom of the clipboard, each slot at a different angle to the vertical and an elongated furrow adjacent to each side.

2. The device according to claim 1 in which the base contains adjacent to each end of a slot an opening for holding a pencil.

* * * * *